US009540211B2

(12) United States Patent
Yu Chen

(10) Patent No.: US 9,540,211 B2
(45) Date of Patent: Jan. 10, 2017

(54) STEPLESS ADHESIVE FILM DISPENSER

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 58 days.

(21) Appl. No.: 14/722,321

(22) Filed: May 27, 2015

(65) Prior Publication Data

US 2016/0347574 A1 Dec. 1, 2016

(51) Int. Cl.
*B65H 75/24* (2006.01)
*B65H 16/04* (2006.01)
*B65H 75/22* (2006.01)

(52) U.S. Cl.
CPC ..... *B65H 75/242* (2013.01); *B65H 16/04* (2013.01); *B65H 75/22* (2013.01)

(58) Field of Classification Search
CPC ..... B65H 16/005; B65H 67/085; B65H 75/22; B65H 75/241; B65H 2220/04; B65H 2402/5152; B65H 2403/731; B65H 2511/12; B65H 2701/1752; B65H 2701/1944; B65H 2701/5152
See application file for complete search history.

(56) References Cited

U.S. PATENT DOCUMENTS 1,410,014 A * 3/1922 Hurlburt ..... B41L 19/00 242/587.2
2,406,435 A * 8/1946 Payne ..... D02H 13/28 242/118.5
2,905,408 A * 9/1959 Stetka ..... B65H 75/22 242/578.2
3,447,759 A * 6/1969 Rau ..... G03B 17/30 242/578.2
5,664,739 A * 9/1997 Black ..... B65H 75/406 242/588.2
7,942,364 B2 * 5/2011 Yu Chen ..... B65H 75/241 242/578.2
9,010,675 B2 * 4/2015 Harrison ..... B65B 67/085 242/578.2
2009/0084074 A1 * 4/2009 Barbery ..... B65B 67/085 53/441
2011/0041458 A1 2/2011 Yu Chen
2011/0042504 A1 * 2/2011 Yu Chen ..... B65H 75/241 242/578.2

* cited by examiner

*Primary Examiner* — William A Rivera
(74) *Attorney, Agent, or Firm* — Ming Chow; Sinorica, LLC

(57) ABSTRACT

A stepless adhesive film dispenser includes a first tube and a second tube fitted on the first tube, and two operating rings are respectively fitted on the circumferential side of the first tube and the second tube and able to rotate freely along the outer circumferential side of the first tube and the second tube. Thus, an adhesive film reel fitted on both the first tube and the second tube can be restrictedly positioned by the operating rings, which can be rotated together with the adhesive film reel. By so designing, when the stepless adhesive film dispenser is used, a user's hands that hold the first tube and the second tube can be avoided rubbing against the adhesive film reel, hence facilitating operation and use of the stepless adhesive film dispenser.

8 Claims, 10 Drawing Sheets

STEPLESS ADHESIVE FILM DISPENSER

BACKGROUND OF THE INVENTION

1. Field of the Invention

This invention relates to an adhesive film dispenser, particularly to a stepless adhesive film dispenser.

2. Description of the Prior Art

Generally, adhesive film is employed for baling and fixing articles so as to avoid the articles swaying and dropping in transit. For the convenience of using adhesive film, the adhesive film is generally wound into a cylindrical shape to make up an adhesive film reel, and a cardboard tube or a rod is inserted through the center of the adhesive film reel so that a user can directly hold two sides of the cardboard tube or the rod with two hands to have the cardboard tube or the rod serving as a center shaft for operating the adhesive film reel.

When used, the adhesive film reel is rotated, with the cardboard tube or the rod acting as a center shaft and at this time, the user's hands that hold the cardboard tube or the rod will incessantly rub against the rotating adhesive film reel, thus causing much inconvenience in operating and using the adhesive film reel. Further, when the adhesive film reel is mounted around the rod for a long period of time, two ends of the adhesive film reel will be deformed and as a result, the adhesive film reel cannot be released continuously, as disclosed in a US patent publication of adhesive film dispenser, No. 2011/0041458. In view of the drawbacks mentioned above, the inventor of this invention thinks that the conventional adhesive film dispenser is necessary to be ameliorated and hence devises this invention.

SUMMARY OF THE INVENTION

The objective this invention is to offer a stepless adhesive film dispenser, which is able to avoid a user's hands being rubbed with an adhesive film reel when the user uses the stepless adhesive film dispenser and thus facilitating use of the adhesive film dispenser.

The stepless adhesive film dispenser in the present invention includes a first tube, a second tube and two operating rings. The first tube has two ends respectively defined to be a combining end and a holding end. The combining end of the first tube has its outer circumferential surface provided with a first threaded portion, and the first tube is disposed with a fitting section at a location adjacent to the holding end. The fitting section of the first tube has its outer circumferential surface provided with a plurality of first ribs, and the holding end of the first tube is fixed thereon with a plurality of second ribs corresponding to the first ribs, and a position-limiting groove is formed between on the first tube and the second ribs. The second tube to be fitted on the first tube has two ends respectively defined to be a combining end and a holding end for corresponding to the first tube. The combining end of the second tube has its inner circumferential surface provided with a second threaded portion corresponding with the first threaded portion of the first tube. The second tube is further provided with fitting section of the second tube ahs its outer circumferential surface set with a plurality of third ribs, and the fitting section of the second tube has its outer circumferential surface set with a plurality of third ribs, and the holding end of the second tube is disposed thereon with a plurality of fourth ribs corresponding to the third ribs, with a second position-limiting groove formed between the third ribs and the fourth ribs. The two operating rings are respectively fitted in the first position-limiting groove of the first tube and the second position-limiting groove of the second tube, able to rotate freely along the outer circumferential side of the first tube and the second tube.

When the stepless adhesive film dispenser of this invention is used, the operating rings can function to restrictedly position an adhesive film reel and rotate together with the adhesive film reel. Thus, a user's hands that hold the first and the second tubes can be avoided being rubbed with the adhesive film reel, facilitating use of the stepless adhesive film dispenser.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
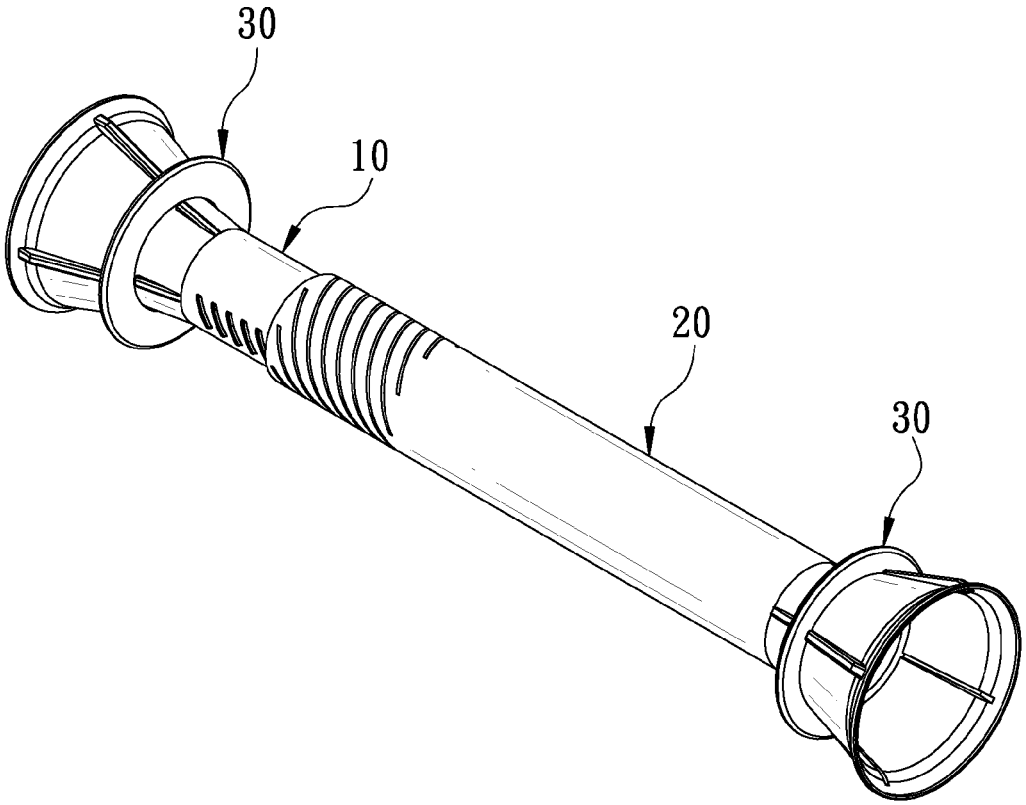
FIG. 1 is a perspective view of a first preferred embodiment of a stepless adhesive film dispenser in the present invention.
Figure 2:
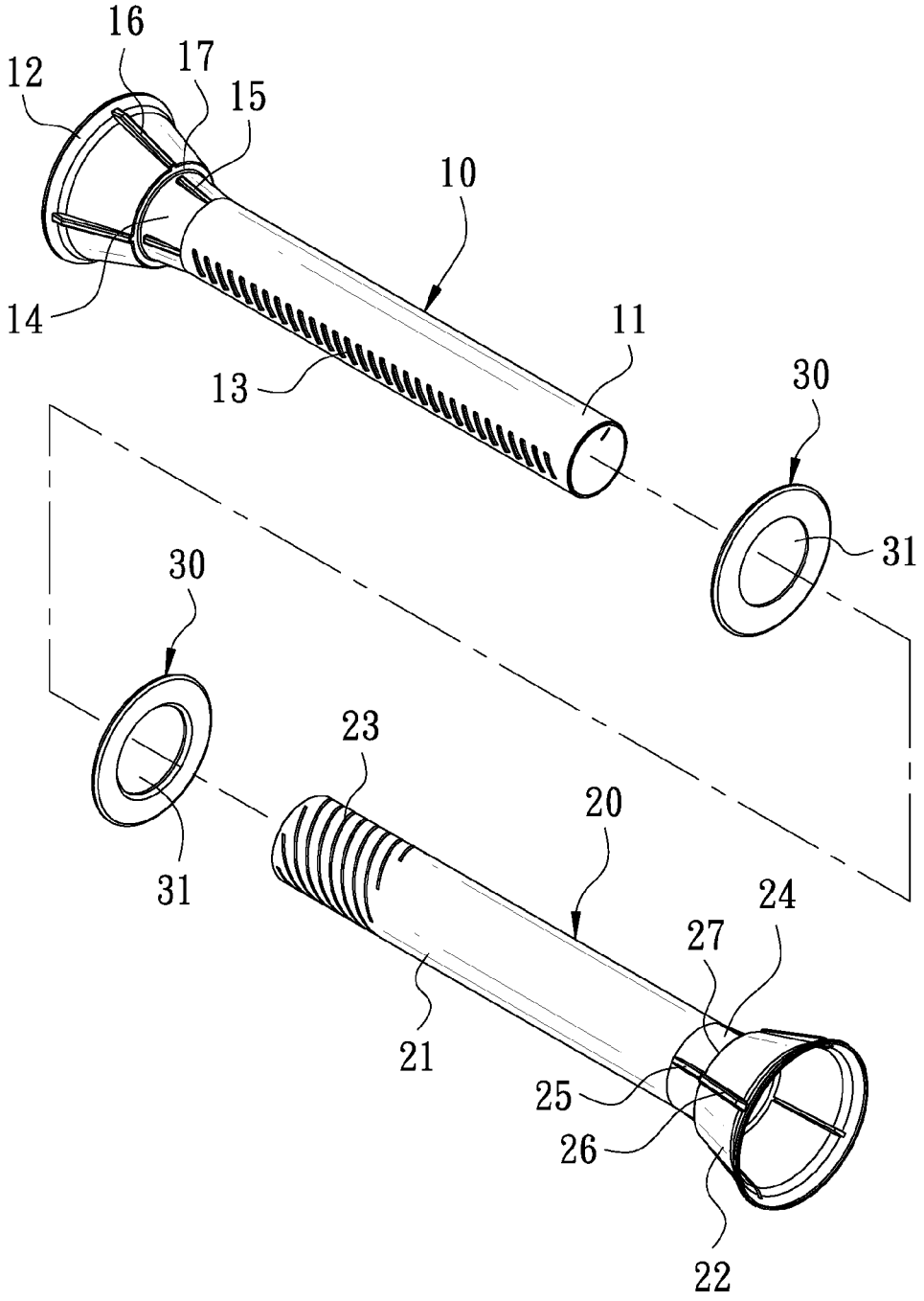
FIG. 2 is an exploded perspective view of the first preferred embodiment of the stepless adhesive film dispenser in the present invention
Figure 3:
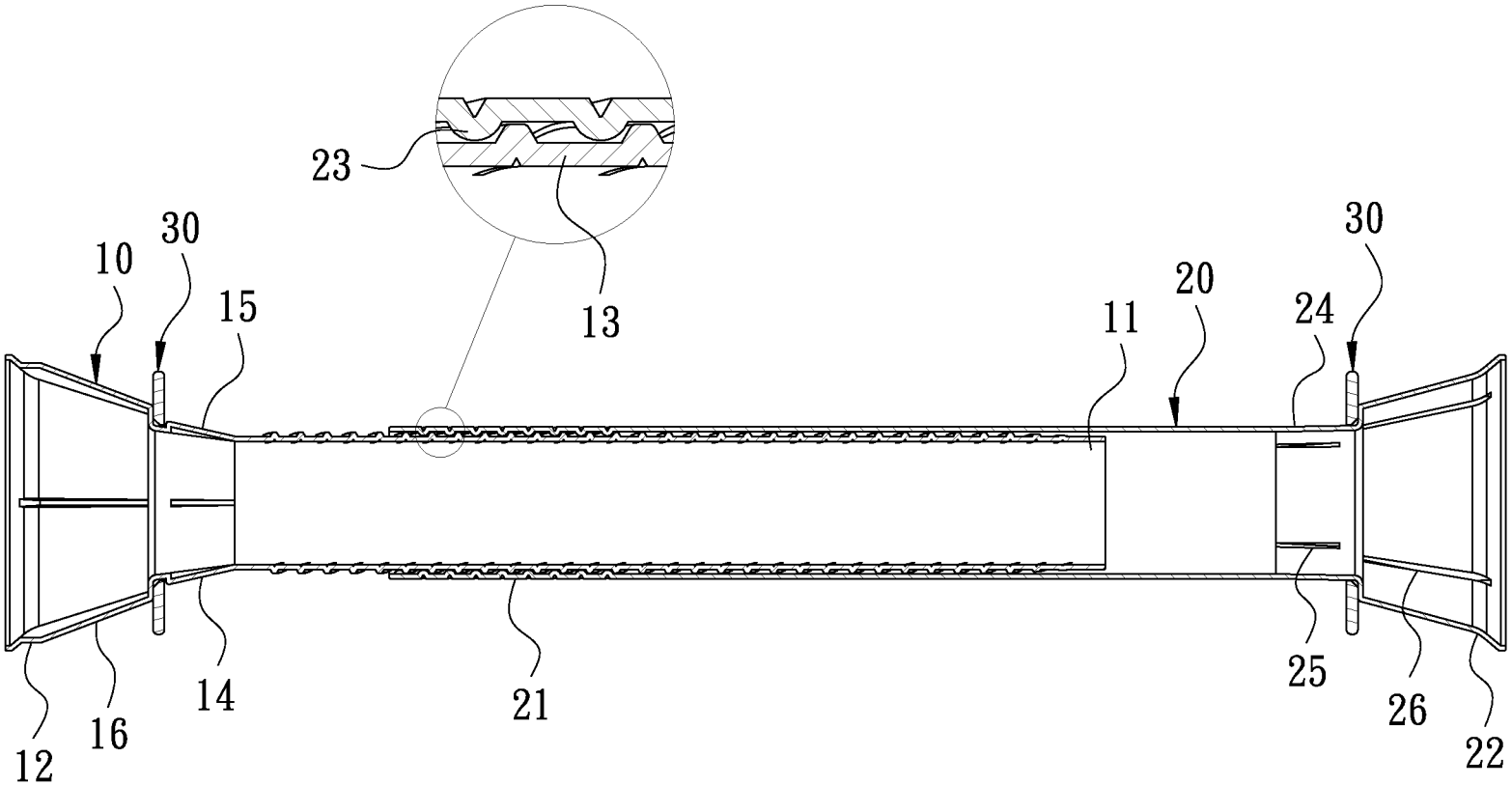
FIG. 3 is a cross-sectional view of the first preferred embodiment of the stepless adhesive film dispenser in the present invention.

A first preferred embodiment of a stepless adhesive film dispenser in the present invention, as shown in FIGS. 1, 2 and 3, includes a first tube 10, a second tube 20 and two operating rings 30 as main components combined together.

Figure 4:
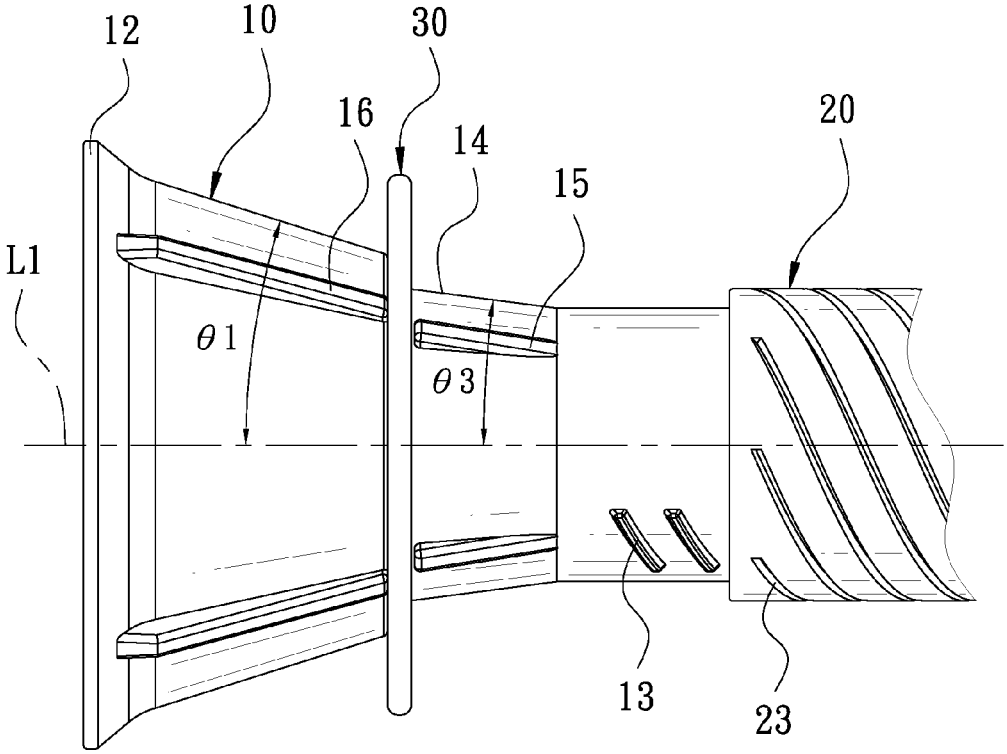
FIG. 4 is a side view of the first preferred embodiment of a first tube in the present invention.
Figure 5:
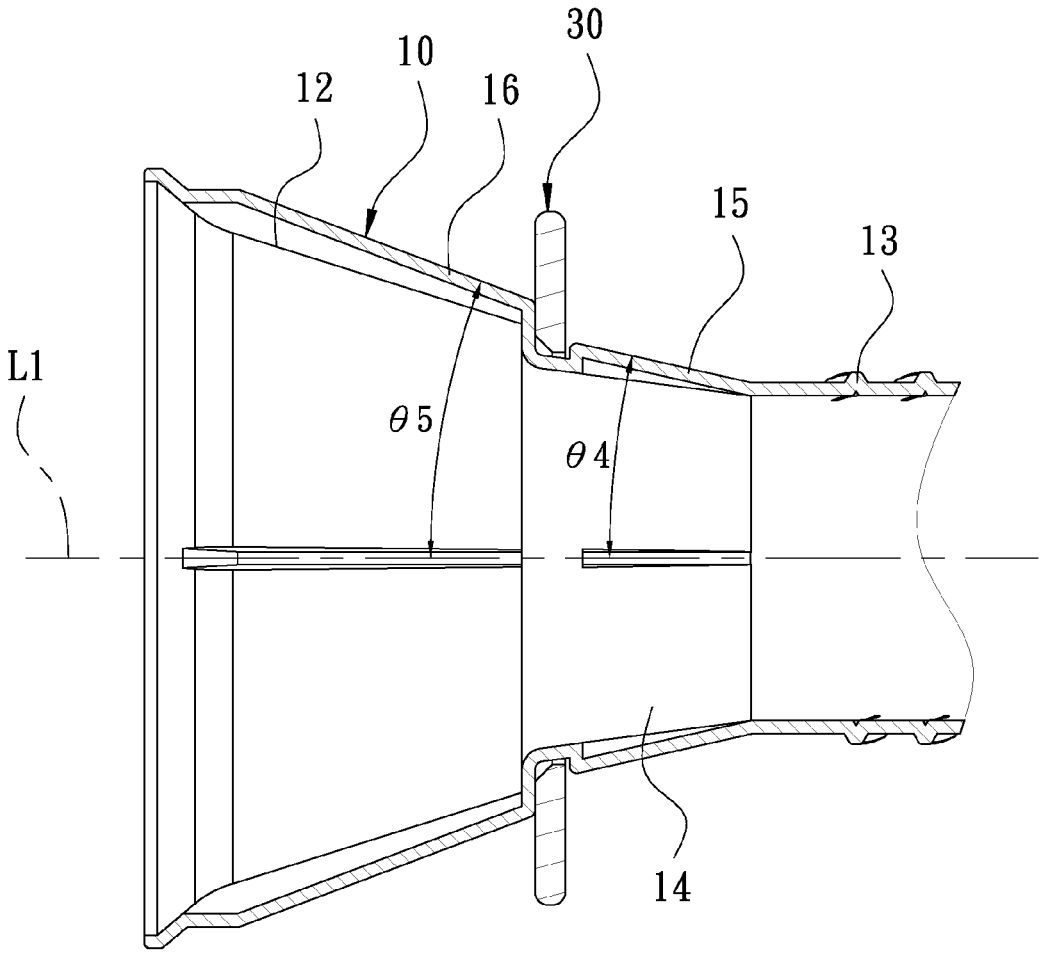
FIG. 5 is a partial cross-sectional view of the first preferred embodiment of the first tube in the present invention.

The first tube 10, referring to FIGS. 2, 4 and 5, is formed with an axis L1, and two ends of the first tube 10 are respectively defined to be a combining end 11 and a holding end 12. The combining end 11 of the first tube 10 has its outer circumferential surface provided with a first threaded portion 13, which is male thread and formed with two-stepped screw threads respectively positioned at the opposite sides of the outer circumferential surface of the first tube 10. The two-stepped threads have one end connected with the combining end 11 of the first tube 10 and another end extending toward the holding end 12 of the first tube 10. The first tube 10 is further provided with a fitting section 14 at a location adjacent to the holding end 12. The fitting section 14 of the first tube 10 has its outer circumferential surface provided with a plurality of first ribs 15, and the holding end 12 of the first tube 10 is disposed with a plurality of second ribs 16 opposite to the first ribs 15, and a first position-limiting groove 17 is formed between the first ribs 15 and the second ribs 16. Further, at the locations of the second ribs 16, the outer circumferential surface of the holding end 12 of the first tube 10 and the axis L1 of the first tube 10 are formed with a first included angle θ1, which is an acute angle to make the holding end 12 of the first tube 10 formed into a conical shape. The outer circumferential surface of the fitting section 14 of the first tube 10 and the axis L1 of the first tube 10 are formed with a third included angle θ3, which is an acute angle to make the fitting section 14 of the first tube 10 heightened by degrees toward the second ribs 16. The outer circumferential surface of the first ribs 15 and the axis L1 of the first tube 10 are formed with a fourth included angle θ4, being is an acute angle, to make the first ribs 15 become higher gradually toward the second ribs 16 along the axis L1 of the first tube 10, and the third included angle θ3 is smaller than the fourth included angle θ4. A fifth included angle θ5 is formed between the outer circumferential surface of the second ribs 16 and the axis L1 of the first tube 10 and the fifth included angle θ5 is an acute angle to make the second ribs 16 become higher and higher toward the first holding portion 12 along the axis L1 of the first tube 10. The fifth included angle θ5 is larger than the first included angle θ1, and the holding end 12 of the first tube 10 is expanded outward to form a flared shape.

Figure 6:
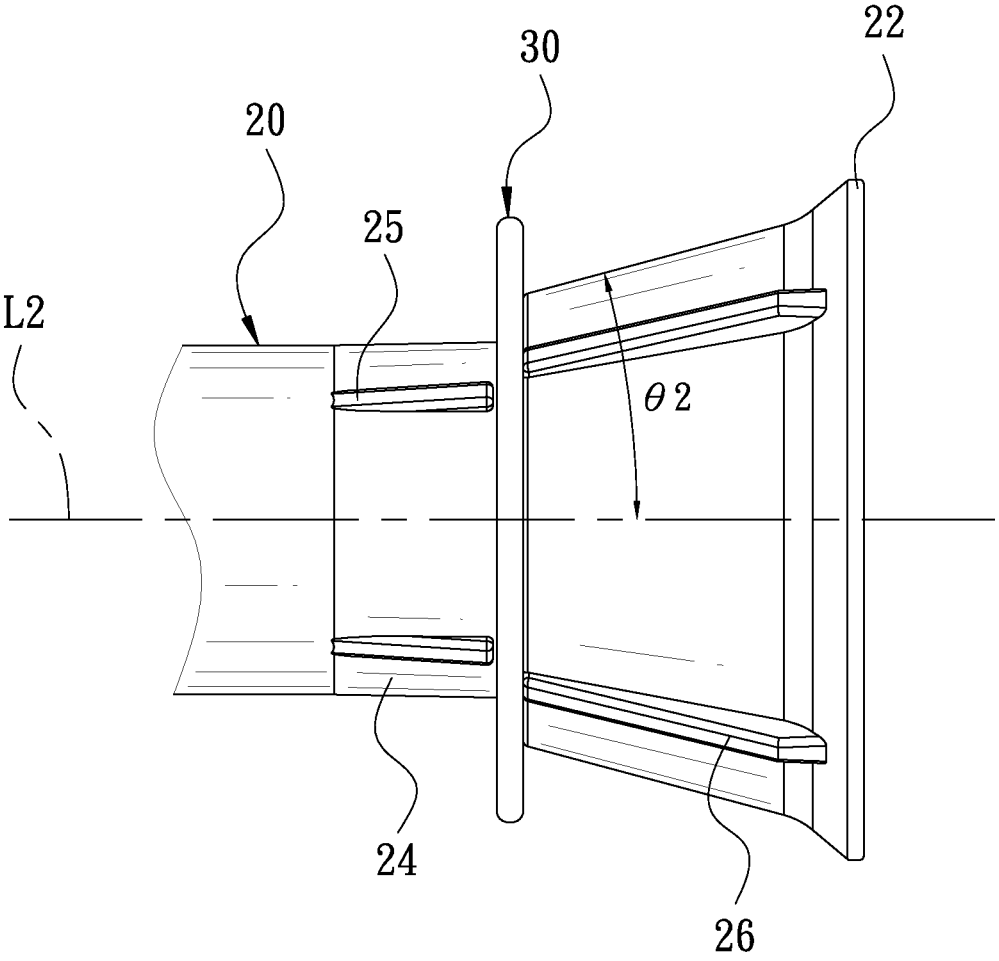
FIG. 6 is a side view of the first preferred embodiment of a second tube in the present invention.
Figure 7:
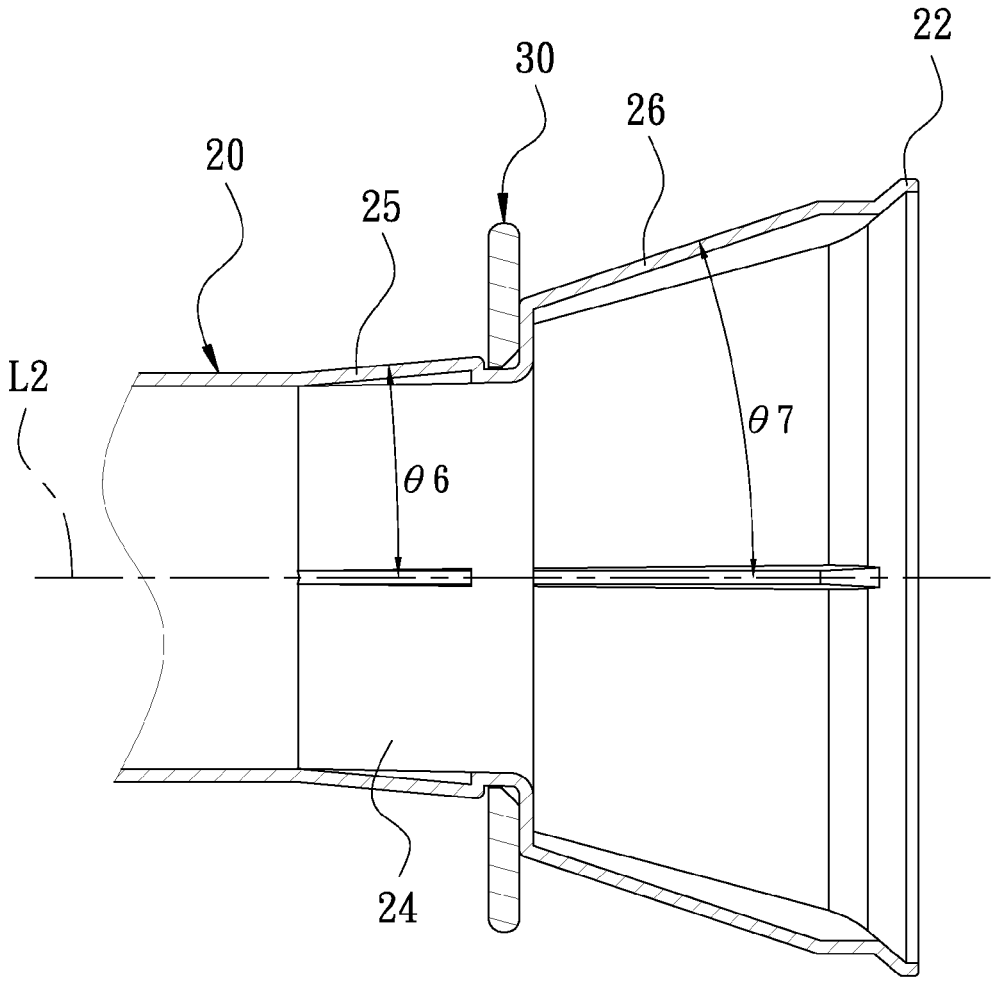
FIG. 7 is a partial cross-sectional view of the first preferred embodiment of the second tube in the present invention.

The second tube 20, referring to FIGS. 2, 6 and 7, is to be fitted on the first tube 10, formed with an axis L2 and having two ends respectively defined to be a combining end 21 and a holding end 22 for corresponding with the first tube 10. The inner diameter of the combining end 21 of the second tube 20 is somewhat larger than the outer diameter of the combining end 11 of the first tube 10 so that the combining end 21 of the second tube 20 can be fitted around the outer side of the combining end 11 of the first tube 10. The combining end 21 of the second tube 20 has its inner circumferential surface provided with a second threaded portion 23 corresponding with the first threaded portion 13 of the first tube 10. The second threaded portion 23 of the second tube 20 is female thread that is annularly formed on the inner circumferential surface of the second tube 20. Thus, the stepless adhesive film dispenser of this invention can be formed with different lengths by adjusting an intermeshing depth of the first threaded portion 13 with the second threaded portion 23. The second tube 20 is provided with a fitting section 24 at a location near the holding end 22. The fitting section 24 of the second tube 20 has its outer circumferential surface fixed thereon with a plurality of third ribs 25, and the holding end 22 of the second tube 20 is disposed with a plurality of fourth ribs 26 corresponding to the third ribs 25, with a second position-limiting groove 27 formed between the third ribs 25 and the fourth ribs 26. At the locations of the fourth ribs 26, the outer circumferential surface of the holding end 22 of the second tube 20 and the axis L2 of the second tube 20 are formed with a second included angle θ2, which is an acute angle, to make the holding end 22 of the second tube 20 formed into a conical shape. The outer circumferential surface of the third ribs 25 and the axis L2 of the second tube 20 are formed with a sixth included angle θ6, being an acute angle, to make the third ribs 25 become higher and higher toward the fourth ribs 26 along the axis L2 of the second tube 20. A seventh included angle θ7 is formed between the outer circumferential surface of the fourth ribs 26 and the axis L2 of second tube 20. The seventh included angle θ7 is an acute angle to make the fourth ribs 26 become heightened gradually toward the second holding portion 24 along the axis L2 of the second tube 20 and the seventh included angle θ7 is larger than the second included angle θ2, and the holding end 22 of the second tube 20 is expanded outward to form a flared shape.

The two operating rings 30 are respectively formed with a round insert hole 31 in the center to be respectively fitted in the first position-limiting groove 17 of the first tube 10 and in the second position-limiting groove 27 of the second tube 20. The two operating rings 30 able to rotate freely along the outer circumferential surface of the first tube 10 and the second tube 20.

Figure 8:
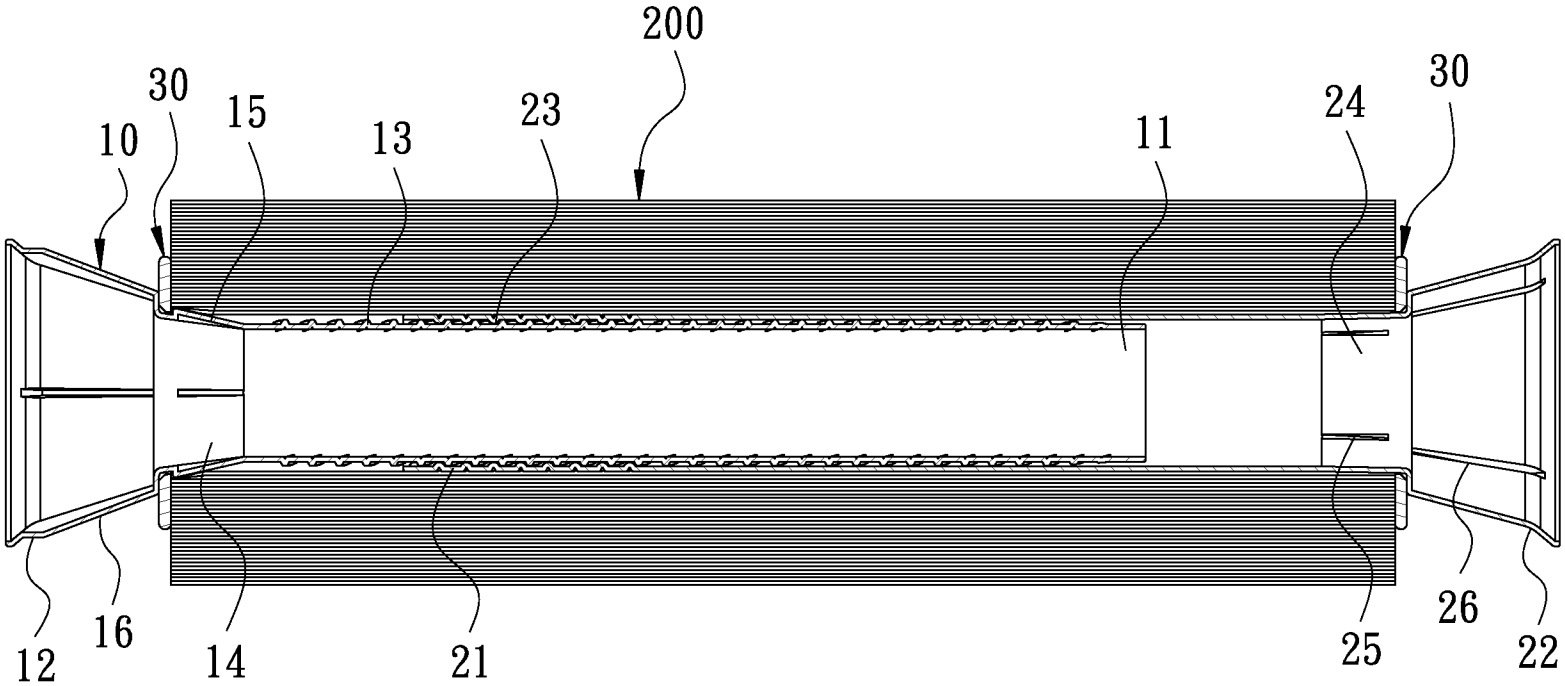
FIG. 8 is a schematic view of the first preferred embodiment of a stepless adhesive film dispenser in a using condition in the present invention.

In use of the stepless adhesive film dispenser, referring to FIG. 8, firstly, the combining end 11 of the first tube 10 and the combining end 21 of the second tube 20 of the stepless adhesive film dispenser are respectively inserted through two ends of the center of an adhesive film reel 200 to have the first threaded portion 13 of the first tube 10 and the second threaded portion 23 of the second tube 20 engaged together and force the first ribs 15 and the third ribs 25 respectively close fit two sides of the adhesive film reel 200, letting the adhesive film reel 200 restrictedly positioned by the two operating rings 30. At this time, a user needs only to have his hands respectively grasping the holding end 12 of the first tube 10 and the holding end 22 of the second tube 20 to let his hands serve as a center shaft for releasing the adhesive film of the adhesive film reel 200. Since the operating rings 30 are rotated together with the adhesive film reel 200; therefore, the user's hands can be avoided rubbing against the first tube 10, the second tube 20 and the adhesive film reel 200, thus, facilitating application of the stepless adhesive film dispenser. In addition, referring to FIGS. 4-7, since the holding end 12 of the first tube 10 and the holding end 22 of the second tube 20 are flare shaped and the operating rings 30 can rotate freely; therefore, a user's hands can be protected from being cut in the course of using the stepless adhesive film dispenser. Moreover, the fifth included angle θ5 of the second ribs 16 of the holding end 12 of the first tube 10 is larger than the first included angle θ1 of the holding end 12 of the first tube 10, and the seventh included angle θ7 of the fourth rib 26 of the holding end 22 of the second tube 20 is larger than the second included angle θ2 of the holding end 22 of the second tube 20; therefore, a user can tightly grasp the stepless adhesive film dispenser, thus enhancing stability in holding and using the stepless adhesive film dispenser.

One of the special features of this invention is that the inner diameter of the combining end 21 of the second tube 20 is a little larger than the outer diameter of the combining end 11 of the first tube 10; therefore, the stepless adhesive film dispenser of this invention can be smoothly adjusted in length. Further, the technical characteristics that the fitting section 14 of the first tube 10 is formed with the third included angle θ3 and the first ribs 15 are formed with the fourth included angle θ4 makes the fitting section 14 of the first tube 10 expanded outward; therefore, when the first tube 10 is screwed together with the second tube 20, the fitting section 14 of the first tube 10 can function to stop the second tube 20, letting the second tube 20 get stuck by the fitting section 14 of the first tube 10 and impossible to touch the operating ring 30 on the first tube 10. Furthermore, by means of the first ribs 15 of the first tube 10 and the third ribs 25 of the second tube 20 and cooperating with the fourth included angle θ4 of the first ribs 15 and the sixth included angle θ6 of the third ribs 25, the adhesive film reel 200 is stretched outward and thus, the adhesive film reel 200 can be prevented from running idle when carrying out tightening operation. Additionally, the operating rings 30 can function to limit the extent that the adhesive film reel 200 is stretched outward by the first ribs 15 and the third ribs 25 and hence, the stepless adhesive film dispenser can still maintain its original shape after used for a long period of time and the adhesive film of the stepless adhesive film dispenser can be released smoothly.

Another special feature of this invention is that, in the course of using the stepless adhesive film dispenser, a user can relatively screw the first tube 10 and the second tube 20 to shorten the stepless adhesive film dispenser to force the operating rings 30 to press tight the adhesive film reel 200 and restrict rotation of the adhesive film reel 200 for changing the tension of the adhesive film in a process of applying the adhesive film reel 200.

Figure 9:
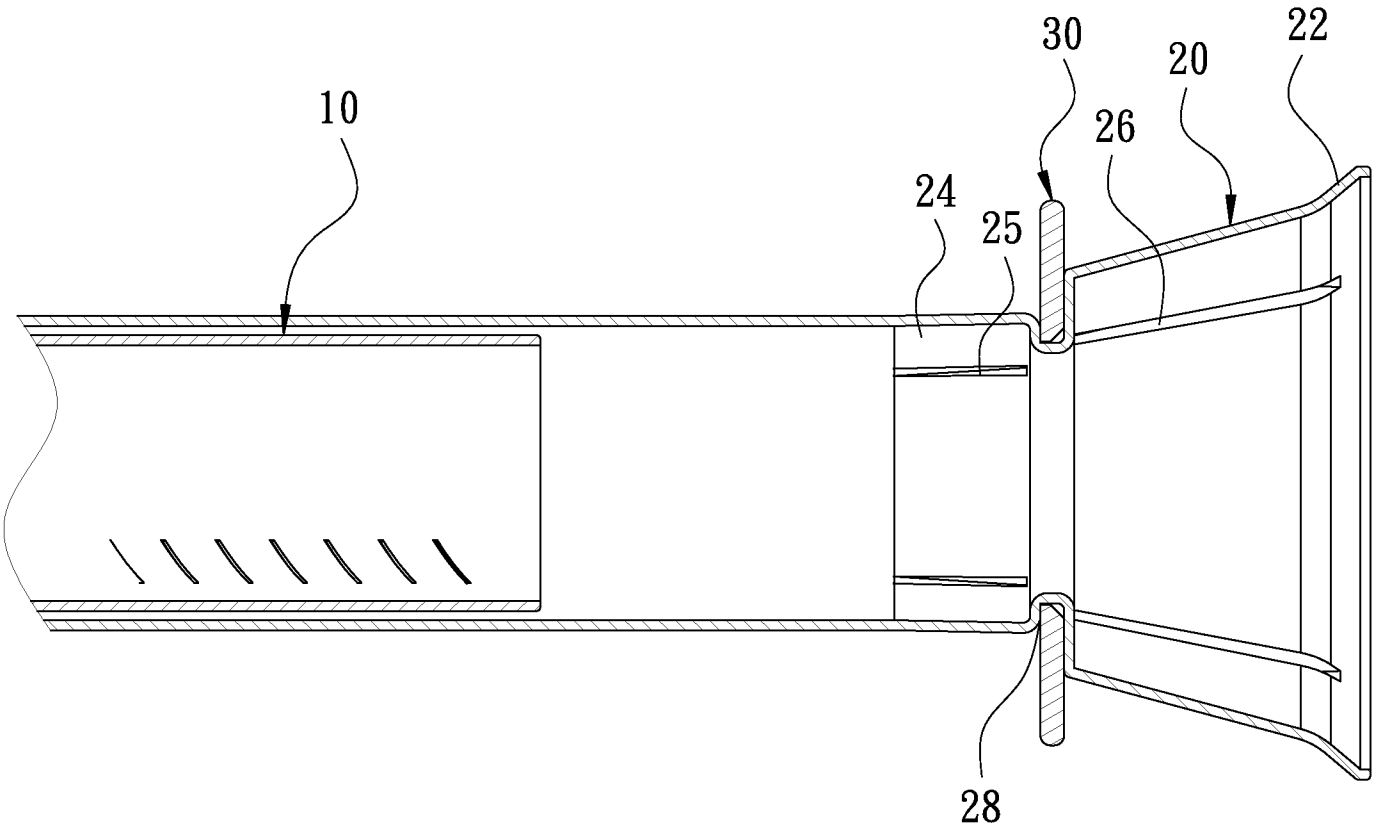
FIG. 9 is a partial cross-sectional view of a second preferred embodiment of a first tube in the present invention.
Figure 10:
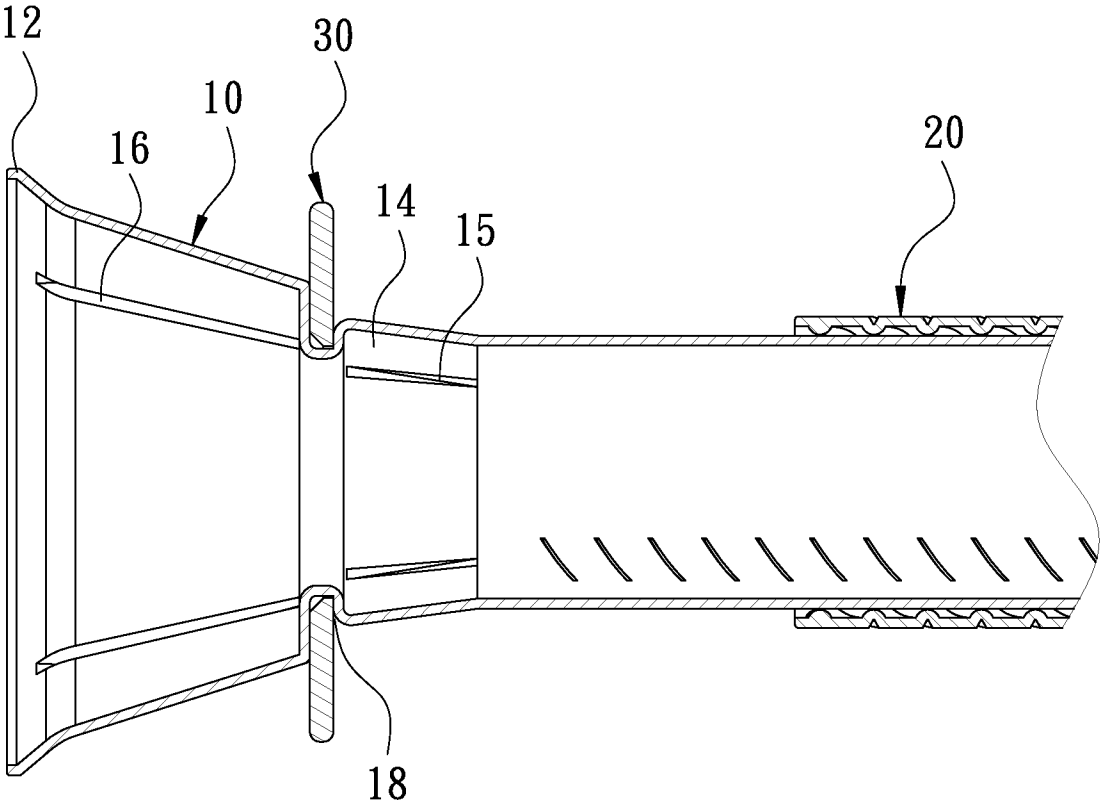
FIG. 10 is a partial cross-sectional view of the second preferred embodiment of a second tube in the present invention.

A second preferred embodiment of a stepless adhesive film dispenser in the present invention, as shown in FIGS. 9 and 10, is almost the same as the first preferred embodiment in structure, except that the first tube 10 is annularly provided with a first position-limiting circular groove 18 corresponding to the position-limiting groove 17, and the second tube 20 is annularly provided with a second position-limiting circular groove 28 corresponding to the second position-limiting groove 27. The operating rings 30 are respectively fitted in the first position-limiting circular groove 18 of the first tube 10 and the second position-limiting circular groove 28 of the second tube and able to rotate freely along the outer circumferential surface of the first tube 10 and the second tube 20. Thus, the position-limiting effect of the operating rings 30 can be further enhaced.

While the preferred embodiments of the invention have been described above, it will be recognized and understood that various modifications may be made therein and the appended claims are intended to cover all such modifications that may fall within the spirit and scope of the invention.

What is claimed is:

1. A stepless adhesive film dispenser comprising:

a first tube having two ends respectively defined to be a combining end and holding end, said combining end of said first tube having an outer circumferential surface provided with a first threaded portion, said first tube provided with a fitting section at a location adjacent to said holding end, said fitting section of said first tube having an outer circumferential surface disposed with a plurality of first ribs, said holding end of said first tube fixed thereon with a plurality of second ribs opposite to said first ribs, a first position-limiting groove formed between said first ribs and said second ribs;

a second tube to be fitted around said first tube, said second tube having two ends respectively defined to be a combining end and a holding end, said combining end of said first tube having an inner circumferential surface provided with a second threaded portion corresponding with said first threaded portion of said first tube, said second tube mounted with a fitting section at a location adjacent to said holding end, said fitting section of said second tube having an outer circumferential surface provided with a plurality of third ribs, said holding end of said second tube fixed thereon with a plurality of fourth ribs opposite to said third ribs, a second position-limiting groove disposed between said third ribs and said fourth ribs; and two operating rings respectively fitted in said first position-limiting groove of said first tube and said second position-limiting groove of said second tube, said operating rings able to rotate freely along an outer circumferential side of said first tube and said second tube.

2. The stepless adhesive film dispenser as claimed in claim 1, wherein said first tube is formed with an axis, an outer circumferential side of said holding end of said first tube and said axis of said first tube formed with a first included angle, an outer circumferential side of said holding end of said second tube formed with a second included angle.

3. The stepless adhesive film dispenser as claimed in claim 2, wherein said first ribs and said axis of said first tube is formed with a fourth included angle, and said second ribs and said axis of said first tube is formed with a fifth included angle, said fifth included angle larger than said first included angle.

4. The stepless adhesive film dispenser as claimed in claim 2, wherein said third ribs and said axis of said first tube is formed with a sixth included angle, and said fourth ribs and said axis of said second tube is formed with a seventh included angle, said seventh included angle larger than said second included angle.

5. The stepless adhesive film dispenser as claimed in claim 1, wherein said holding end of said first tube is annularly formed with a first position-limiting circular groove corresponding to said first position-limiting groove, and said holding end of said second tube is provided with a second position-limiting circular groove corresponding to said first position-limiting groove.

6. The stepless adhesive film dispenser as claimed in claim 1, wherein said first tube is formed with an axis, an outer circumferential side of said fitting section of said first tube and said axis of said first tube is formed with a third included angle, said first ribs and said axis of said first tube formed with a fourth included angle, said third included angle smaller than said fourth included angle.

7. The stepless adhesive film dispenser as claimed in claim 1, wherein said first threaded portion is male thread and formed with two-stepped screw threads respectively provided at opposite sides of the outer wall of said first tube, said second threaded portion being female thread annularly provided on the inner wall of said second tube.

8. The stepless adhesive film dispenser as claimed in claim 7, wherein said screw threads have one end connected with said combining end of said first tube and another end extending toward said holding end of said first tube.

* * * * *